US005521330A

United States Patent [19]

Kuwano

[11] Patent Number: 5,521,330

[45] Date of Patent: May 28, 1996

[54] SOUND CONTROL DEVICE AND METHOD FOR UNIFORMLY SHIFTING THE PHASE OF SOUND DATA

[75] Inventor: Koji Kuwano, Hamamatsu, Japan

[73] Assignee: Kawai Musical Inst. Mfg. Co., Ltd., Japan

[21] Appl. No.: 224,774

[22] Filed: Apr. 8, 1994

[30] Foreign Application Priority Data

Apr. 8, 1993 [JP] Japan ..... 5-082073

[51] Int. Cl.[6] ..... G10H 1/02

[52] U.S. Cl. ..... 84/662; 84/701; 84/DIG. 1

[58] Field of Search ..... 84/622–633, 659–665, 84/692–711, 735–741, DIG. 4, DIG. 5, DIG. 26, DIG. 27, DIG. 1; 381/61–65

[56] References Cited

U.S. PATENT DOCUMENTS 3,626,077 12/1971 Munch et al. ..... 84/DIG. 4

4,043,243 8/1977 Peterson ..... 84/DIG. 4

4,080,861 3/1978 Wholahan ..... 84/DIG. 4

4,186,643 2/1980 Nishibe et al. ..... 84/DIG. 4

*Primary Examiner*—Stanley J. Witkowski

[57] ABSTRACT

A sound control device and method which increase the width of sound of sound data by controlling and outputting the phase of the sound data, in which the phase of the generated sound data is uniformly shifted over the entire frequency band of the related sound data and in which this sound data shifted in phase and the above described generated original sound data are output to different sound systems. By this, sound data with a phase which is uniformly shifted and the original sound data are converted to sound by sound systems different from each other, and therefore the width of the sound is expanded

18 Claims, 9 Drawing Sheets

SOUND CONTROL DEVICE AND METHOD FOR UNIFORMLY SHIFTING THE PHASE OF SOUND DATA

BACKGROUND OF THE INVENTION

1. Field of the Invention

The present invention relates to a device and a method for controlling sound, more particularly the present invention relates to a device and a method for controlling the phase of sound data to give width of sound 2. Description of the Related Art Conventionally, various effect devices for controlling the frequency components of a musical tone have been known. One of these effect devices is a digital filter. A signal input to this digital filter has not only the gain of each frequency component shifted, but also the phase of each component shifted.

The phase shift of an output signal relative to the phase of the signal which is input to such a digital filter is not constant over all frequencies. Also, the phase shift value differs according to the frequency value. A signal passing through this filter has the gain of a specific frequency component shifted, but also has the phase shifted. Rather, an excessive shift is given to a musical tone. This was not preferred in terms of the quality of the sound.

Contrary to this, it is also possible to consider the use of an all pass filter allowing signals of the entire frequency band to pass through. However, even with an all pass filter, the shift of the phase of the signal which is output relative to the phase of the signal which is input is still not constant in all frequencies. It is desirable that the phase difference between an input signal and an output signal be constant in the entire frequency band from the viewpoint of the width of sound.

SUMMARY OF THE INVENTION

The present invention was made so as to solve the above-mentioned problem and has as an object thereof to provide a sound control device and method such that the phase shift of the sound data is uniform over the entire frequency band and such that sound control which increases the width of sound can be performed.

So as to achieve the above-described object, according to an embodiment of the present invention, sound data is generated; phase data for changing the phase of this generated sound data is generated; based on this generated phase data, the phase of the above-described generated sound data is shifted uniformly over almost the entire frequency band of the related sound data; and this phase-shifted sound data and the above-described generated sound data are output to different sound systems.

By this, the sound data with a phase which has been uniformly shifted and the original sound data are converted to sound by respectively different sound systems, and therefore the width of sound is increased in the sound which is produced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above objects and features of the present invention will be more apparent from the following description of the preferred embodiments with reference to the accompanying drawings, which are given by way of illustration only, and thus are not limitative of the present invention and wherein.

DESCRIPTION OF THE PREFERRED EMBODIMENTS

Summary of an Embodiment

Figure 1:
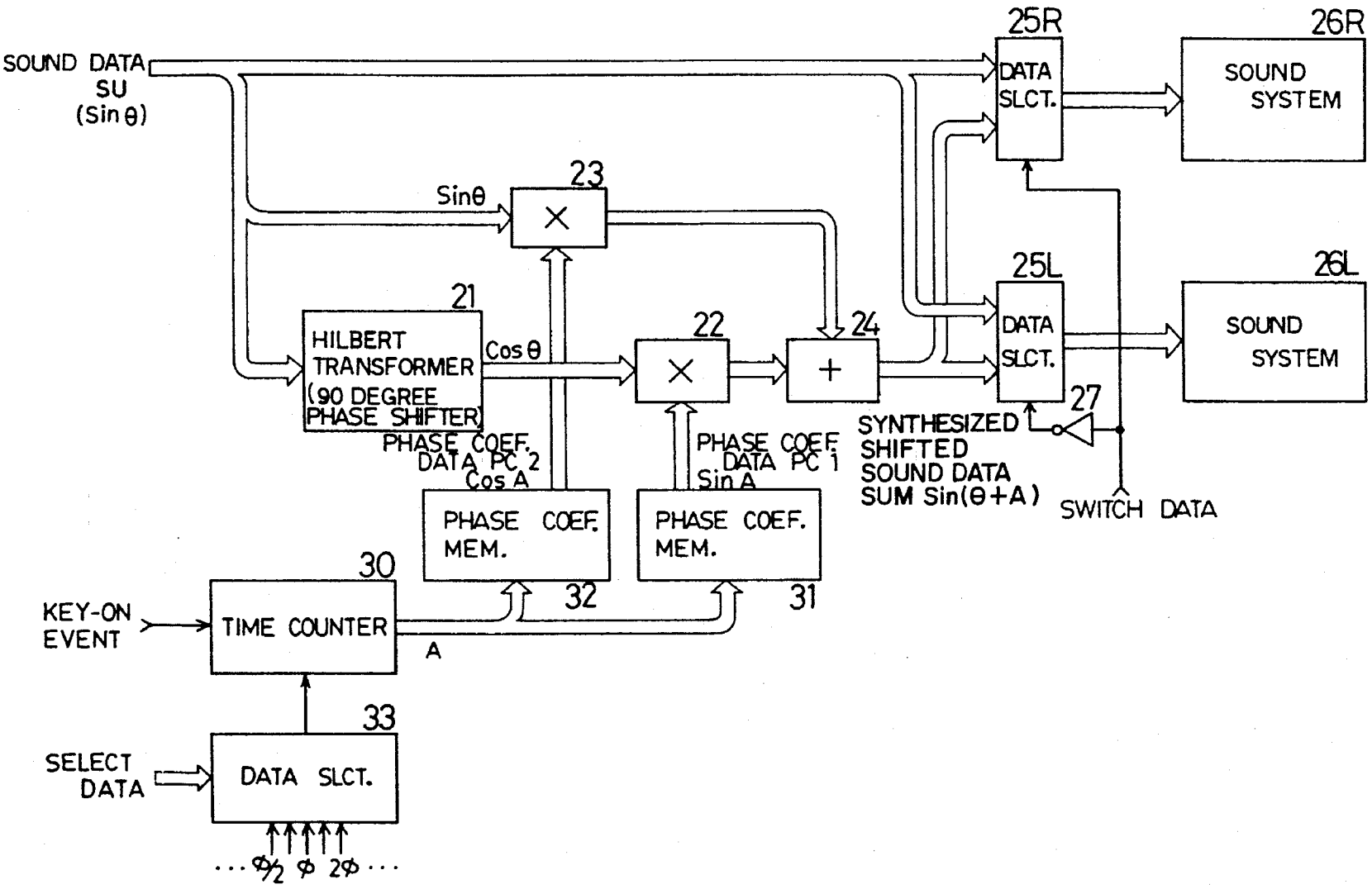
FIG. 1 is a circuit diagram of a phase control circuit 20.

First, summarizing an embodiment, in FIG. 1, sound data sinθ becomes sound data cosθ having a phase advanced (shifted, modified, changed) by 90 degrees through a Hilbert transformer 21. This sound data sinθ is multiplied by the converted phase coefficient data PC of cosA at a multiplier 23, the above-described sound data cosθ is multiplied by the converted (transformation) phase coefficient data PC of sinA at a multiplier 22, and the two multiplied data are added at an adder 24. As a result, cosA'sinθ+sinA'cosθ sin(θ+A) stands, and the phase is advanced only by "A". This phase-advanced sound data and the original sound data are sent to different sound systems.

1. phase control circuit 20

FIG. 1 shows a phase control circuit 20. This phase control circuit 20 is provided in an electronic musical instrument. Sound data SU is input to this phase control circuit 20, where phase control is carried out. This sound data SU is generated from a tone generator 8 in a time divisional (sharing) manner as described later with respect to FIG. 7, and includes data accumulated at accumulation circuits 10R and 10L, data input via a MIDI interface, automatic performance data, etc.

This sound data SU is made data advanced (shifted, modified, changed) in phase by 90 degrees over the entire frequency band by a Hilbert transformer 21 (90-degree phase shifter). This shifted (modified, changed) sound data SU is multiplied by the converted (transformation) phase coefficient data PC1 at the multiplier 22 and then is sent to the adder 24. The above-described sound data SU also is multiplied by the converted phase coefficient data PC2 at the multiplier 23 and sent to the adder 24 without being passed through the Hilbert transformer 21. The above-described converted phase coefficient data PC1 is a value of sinA and the converted phase coefficient data PC2 is a value of cosA.

Here, when defining the above-described sound data SU as sinθ, the shifted sound data Su advanced in phase by 90 degrees described above becomes cosθ. By this, the synthesized (combined) shifted (transformation, advanced, modified, changed) sound data SUM passed through the above-described multipliers 22 and 23 and adder 24 becomes as follows:

$$\cos A'\sin\theta+\sin A'\cos\theta=\sin(\theta+A)$$

In this, the original sound data SU and the shifted (transformation, advanced, modifyed, changed) sound data SU are synthesized (combined) by the ratio "cosA" and "sinA", and the synthesized shifted sound data SUM from the adder 24 becomes data with a phase which is advanced exactly by "A" from the original sound data SU. In addition, the Hilbert transformer 21 uniformly advances the phase of the sound data SU by 90 degrees over the entire frequency band. Accordingly, the "θ" of sinθ of the above-described operation equation stands at all frequency values.

Either of the synthesized shifted sound data SUM advanced in phase by "A" from the above-described adder 24 or the original sound data SU is selected at a data selector 25R and is sent to a sound system 26R of a right sound source to generate a sound. Also, either of the above-described synthesized shifted sound data SUM or the original sound data SU is selected at a data selector 25L and is sent to a sound system 26L of a left sound source to generate a sound. Switching data is supplied to the data selector 25R as the select signal as it is. At the same time, the switching data inverted via an inverter 27 is supplied to the data selector 25L as the select signal. By this, the value of the switching data is switched to "1" or "0", whereby the right sound source and left sound source are selected according to either of the synthesized shifted sound data SUM or the original sound data SU.

A time counter 30 is driven when the power source is turned ON. A key on event signal is supplied to this time counter 30 as a reset signal. This key on event signal is supplied from an envelope generator in the tone generator 8 or from a key scan circuit 2 via a central processing unit (CPU) 5. In this time counter 30, the value of "A" of "sinA" and "cosA" described above, that is, the phase coefficient data PC, is ring-counted, and the value within a range of from 0 degree to 360 degrees (0 to 2π) is repeatedly counted. It is also possible to use other ranges of value for this counting range, for example, 0 degree to 180 degrees (0 to π), −180 degrees to 180 degrees (−π to π), and 0 degree to 90 degrees (0 to π/2).

This count value "A", that is, the phase coefficient data PC, is sent to the phase coefficient memories 31 and 32, the above-described converted phase coefficient data PC of "sinA" and "cosA" are read out and sent to the above-described multipliers 22 and 23. Sine functional data are stored in the phase coefficient memory 31, "A" is used as the read out address data, and "sinA" is read out. Cosine functional data are stored in the phase coefficient memory 32, "A" is used as the read out address data, and "cosA" is read out. By this, in accordance with the lapse of time from the key on, the phase of the synthesized shifted sound data SUM relative to the original sound data SU is shifted, and a tremolo effect is realized.

When the value of the phase coefficient data PC becomes 180 degrees to 360 degrees (π to 2π), the synthesized shifted sound data SUM enters into the same state as one delayed in phase with respect to the sound data SU. Note that, the phase coefficient memories 31 and 32 can be replaced by a digital signal processor, microcomputer, etc. which perform the same operation. Also, one of the phase coefficient memory 31 or 32 can be replaced by a circuit performing the operation of SQR ($1-\cos^2 A$) or SQR ($1-\sin^2 A$). SQR is a symbol indicating the operation of finding a square root.

To the above-described time counter 30 are input clock signals determining a count velocity. In this case, clock signals ϕ, 2ϕ, 4ϕ, . . . ,ϕ/2, ϕ/4, ϕ/8, . . . which are respectively different frequencies, and, "no clock signal" are selected via a data selector 33 and input to the time counter 30. When "no clock signal" is selected, the counting operation of the time counter 30 is stopped. The selected data of this data selector 33 is a high-order data of the count value of the time counter 30, various types of musical factor data, or the input data from a phase slide switch.

The above-described various types of musical factor data include tone color data, a tone pitch range data (high-order data of pitch data), high-order data of touch data, envelope phase data, high-order data of envelope level data, musical tone part data, modulation data, high-order data of tempo data, rhythm type data, effect type data, effect amount data, volume data, tempo data, etc.. By this, the change over time of the phase is itself changed in accordance with the musical factor. The above-described envelope phase data is supplied from the envelope generator in the tone generator 8. Also, it is possible even if the reset signal of the above described time counter 30 is part or all of the envelope phase data.

It is also possible even if "A" of the above-described "sinA" and "cosA", that is, the phase coefficient data PC, is the above-mentioned various types of musical factor data or the input data from the phase slide switch. By this, in accordance with the musical factor and the sliding operation of the phase slide switch, the phase of the synthesized shifted sound data SUM is shifted relative to the original sound data SU.

Figure 6:
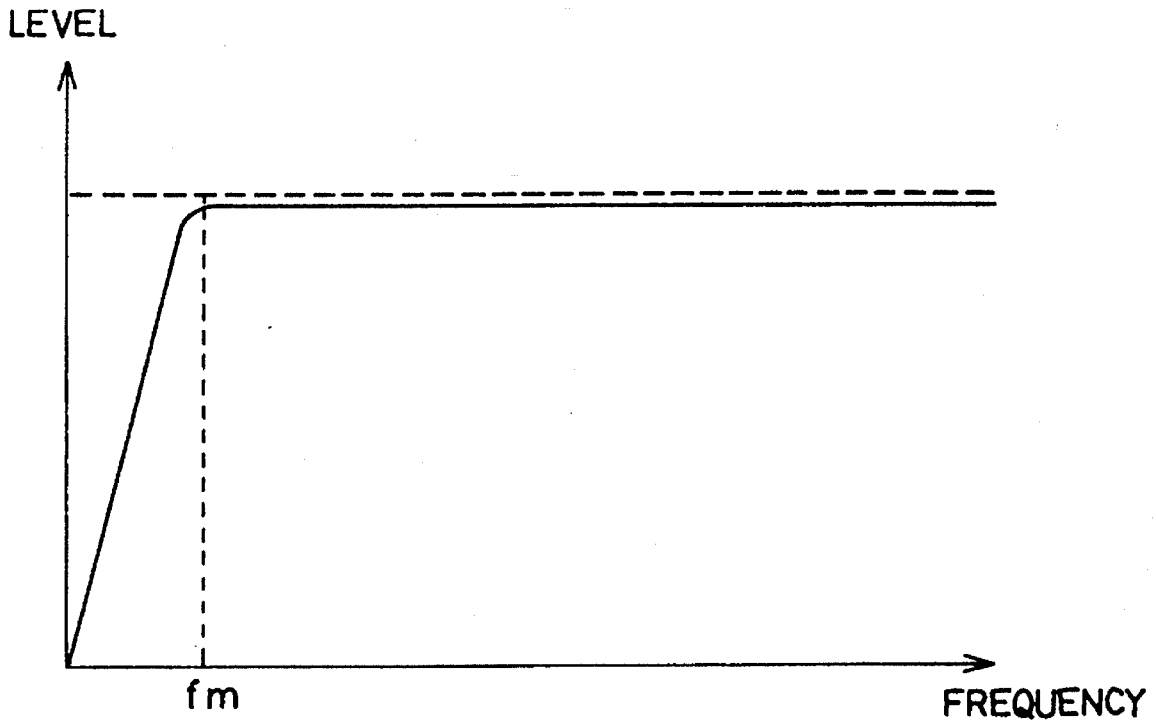
FIG. 6 is a view of the characteristic of an amplitude and frequency of sound data SU to be controlled in phase.
Figure 7:
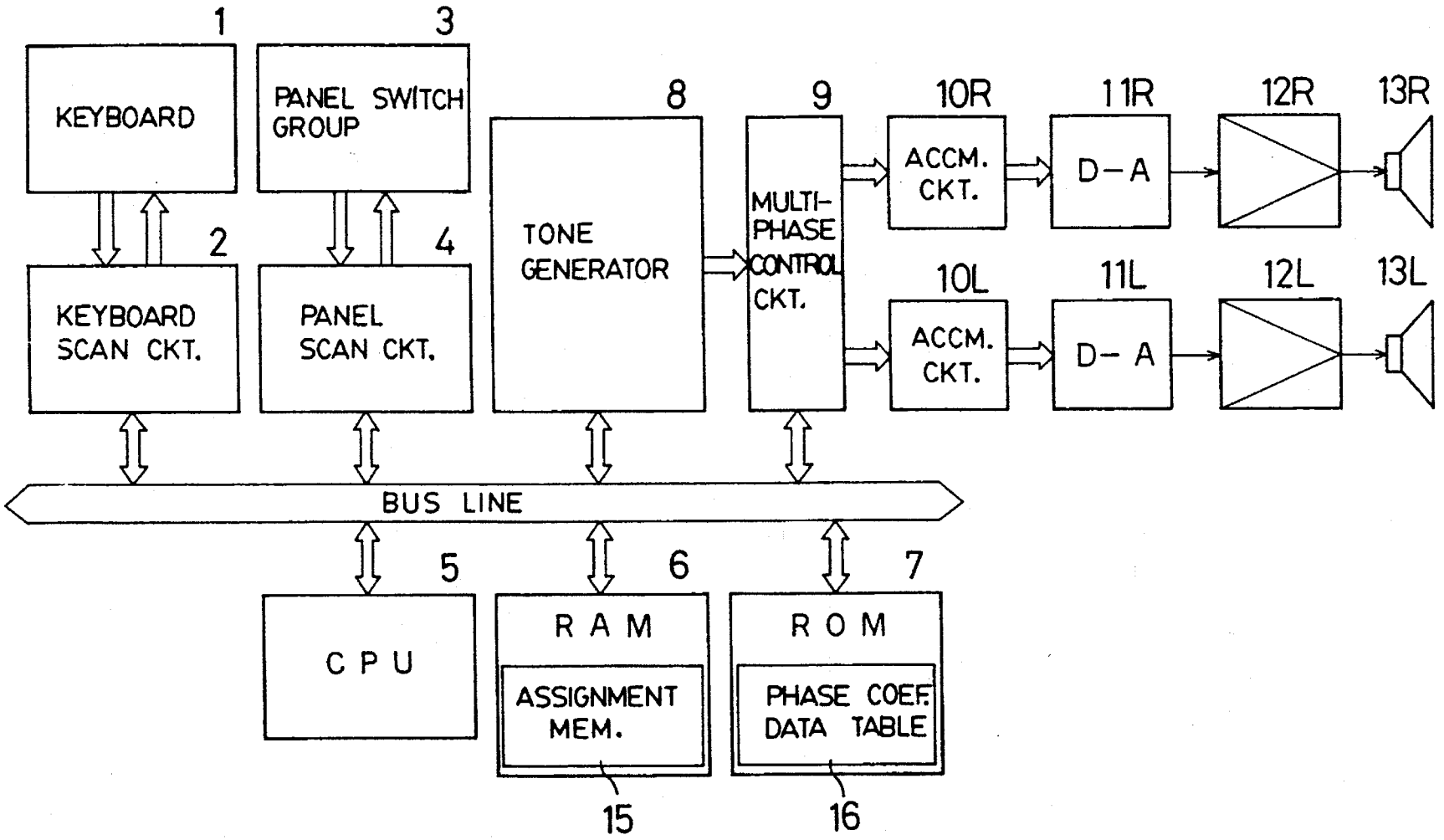
FIG. 7 is an overall circuit diagram of an electronic musical instrument.
Figure 8:
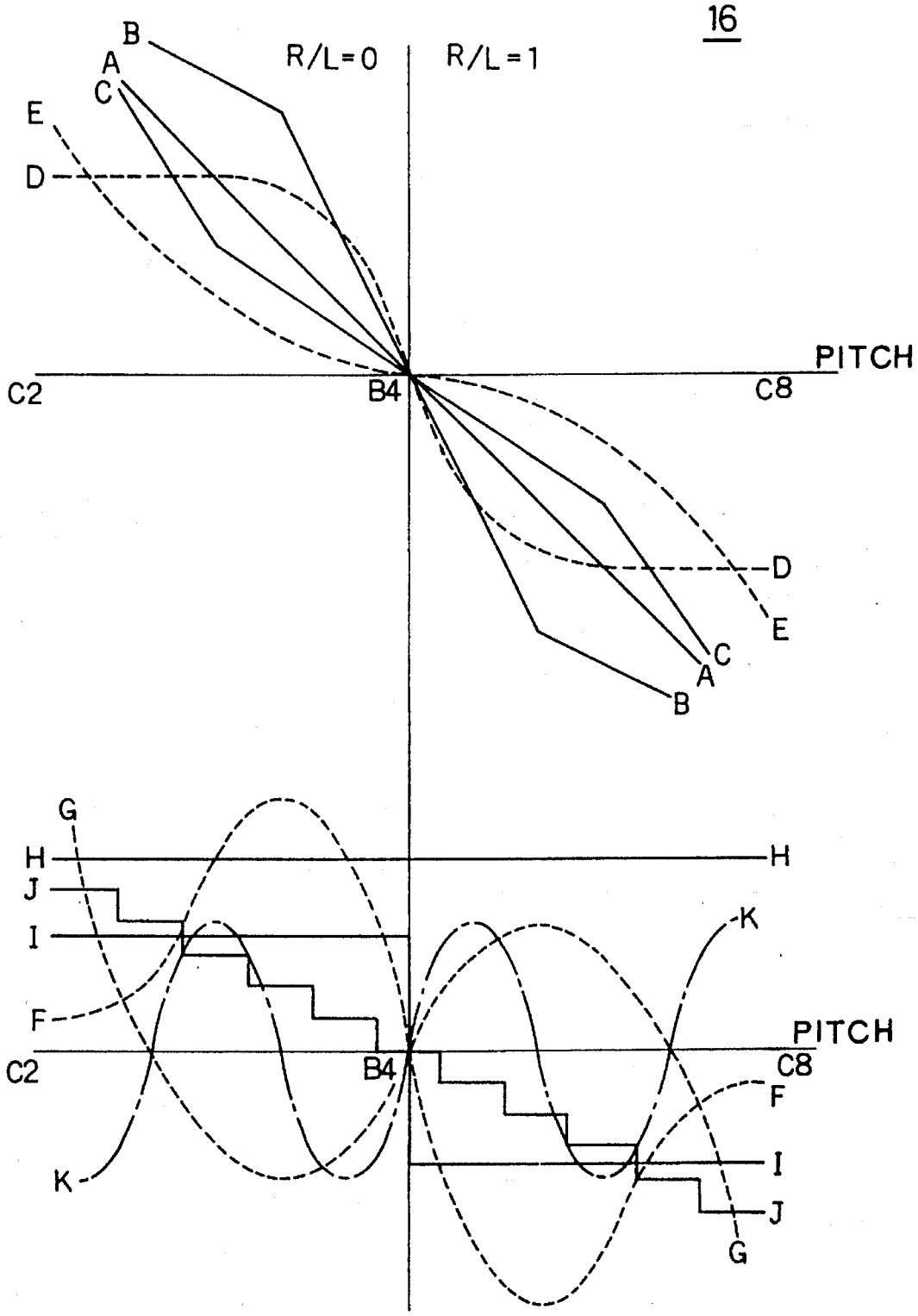
FIG. 8 is a view of the contents of a phase coefficient data table 16 stored in a read only memory (ROM) 7.

Note that, it is also possible even if the sound data SU and synthesized shifted sound data SUM output from the above-described data selectors 25R and 25L are input to the level shifters 36R and 36L of FIG. 7 and the panpot circuits 9R and 9L of FIG. 8 of U.S. application Ser. No. 07/813,933. By this, combination with a stereo system becomes possible, and the width of sound is further increased. Moreover, it is also possible even if the sound data SU and the synthesized shifted sound data SUM which are output from the above-described data selectors 25R and 25L are input to the demultiplexors 10*a* and 10*b* of FIGS. 3 and 6 and the respective input terminals of FIG. 5 of U.S. application Ser. No. 07/965,706. By this, the two sound data SU and SUM are synthesized (combined) and output, these synthesized sound data SU and SUM are distributed and output, and the width of sound becomes still further larger.

The multipliers 22 and 23 and the adder 24 of the phase control circuit 20 of FIG. 1 described above can be replaced by another phase control circuit or a digital signal processor or a microcomputer which executes a program operation.

2. converted phase coefficient data PC

Figure 2:
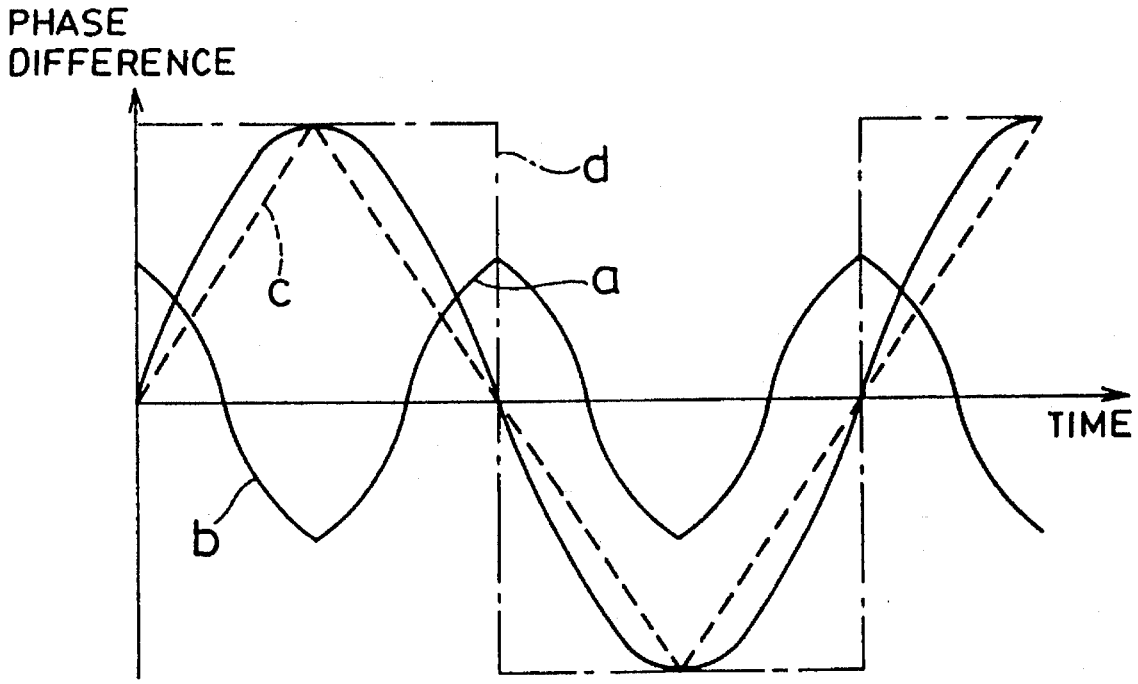
FIG. 2 is a view of the changes over time of a converted phase coefficient data PC.

FIG. 2 shows the change over time of the above-described converted phase coefficient data PC. The curve of a is a sine wave of sinA (0 degree≦A≦360 degrees (0 to 2π)), the curve of b is a cosine wave of cosA (−90 degrees≦A≦+90 degrees (−π/2 to π/2)), the curve of c is a chopping wave of A/90 (0 degree≦A≦ 90 degrees (0 to π/2)), and the curve of d shows a rectangular wave of 1 (0 degrees≦A≦180 degrees (0 to π)) and −1 (180 degrees≦A≦360 degrees (π to 2π)).

Any converted phase coefficient data PC of a to d can be stored in the phase coefficient memories 31 and 32, or they can be rewritten by the CPU 5.

The center phase angle of the curves of a to d described above is 0 degree, but it is also possible even if the curves are vertically slid to shift the center phase angle of the curves. Also, although the modulation angle of the curve of b is ≦90 degrees and the modulation angle of the curve of a, c and d is ≦180 degrees, they can be arbitrarily shifted by changing the vertical scale. For example, they can be shifted to ranges of from −60 degrees to +120 degrees and from −180 degrees to +45 degrees.

3. Hilbert transformer 21

Figure 3:
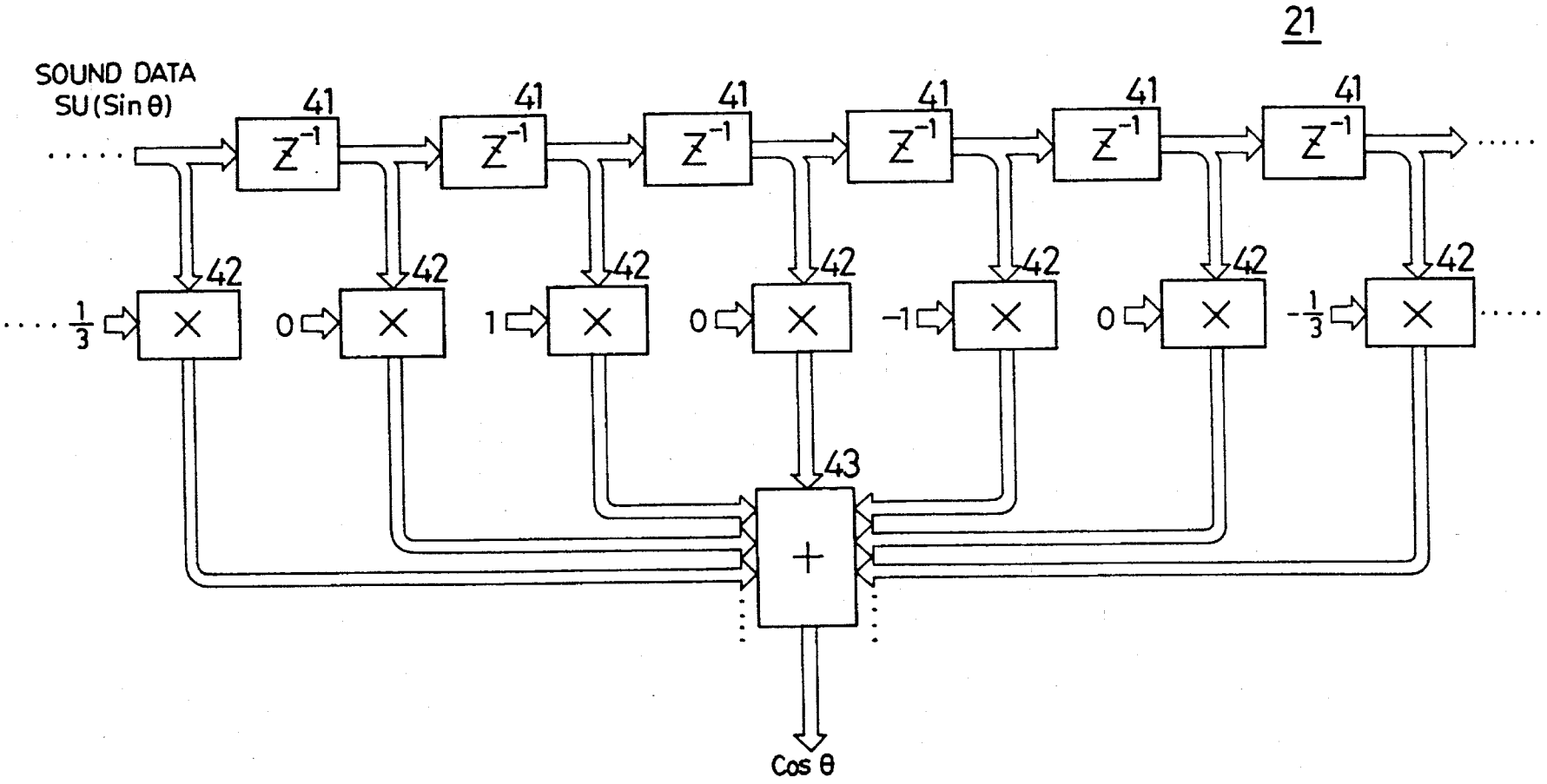
FIG. 3 is a circuit diagram of a Hilbert transformer 21.

FIG. 3 shows the above-described Hilbert transformer 21. The above-described sound data SU is delayed by one step worth of sampling frequency fs of the sound data SU at one time via the delay circuits 41, . . . . These delay circuits 41, . . . can be constituted by for example a charge coupled device (CCD). The respective delayed sound data SU are added at the adder 43 via the multipliers 42, . . . and output. The output of the center delay circuit 41 among the above-described delay circuits 41, . . . is multiplied by "0" at the multiplier 42, and the outputs of two delay circuits 41 and 41 on the two sides of this are multiplied by "1" and "−1" at the multipliers 42 and 42. Further, the outputs of the outside two delay circuits 41 and 41 are multiplied by "0" at the multipliers 42 and 42, and the outputs of the further outside two delay circuits 41 and 41 are multiplied by "⅓" and "−⅓" at the multipliers 42 and 42, so that "0" and "±1/(2n+1) (n=1, 2, 3, . . . )" are alternately multiplied.

The number of stages of these delay circuits 41, . . . is found from a relationship between the sampling frequency fs of the sound data SU and the lowest frequency fm of the sound data SU to be subjected to the phase control. Namely, the number of stages of the delay circuit 41 becomes fs/fm or more. For example, if the sampling frequency fs is 36 kHz and the lowest frequency fm is 36 Hz, the number of stages of the delay circuit 41 becomes "1000". If the number of stages of the delay circuit 41 is made large, the lowest frequency fm which can be controlled in phase becomes small.

FIG. 6 shows the amplitude frequency characteristic of the sound data SU to be phase controlled, in which the level abruptly falls at the lowest frequency fm or less. However, the components of the lowest frequency fm or less are not included in the sound data SU, and therefore there occurs no problem in practice. Of course, it is also possible to increase the number of stages of the delay circuits 41 to modify the same to an ideal type indicated by a dotted line in FIG. 6. It is also possible even if this lowest frequency fm is a basic frequency of the sound data SU, a predetermined rate of the basic frequency, or a ½, ⅓, ⅔, ¼, ¾, . . . frequency value.

Figure 4:
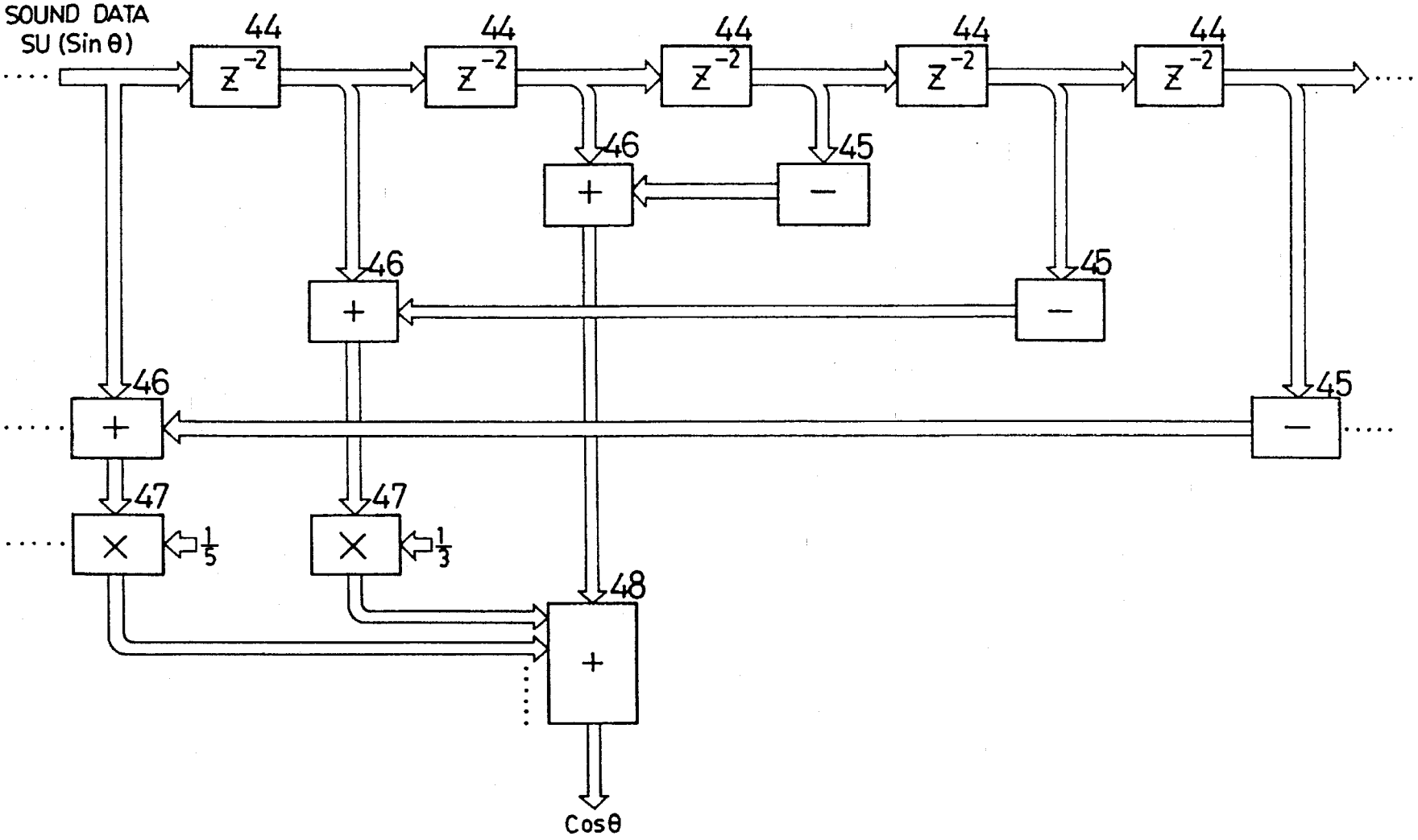
FIG. 4 is a circuit diagram of another example of the Hilbert transformer 21.

FIG. 4 shows another example of the Hilbert transformer 21. The above-described sound data SU is delayed by 2 steps worth of the sampling frequency fs of the sound data SU at a time via the delay circuits 44, . . . . These delay circuits 44, . . . can also be constituted by a CCD etc.. The output of the delay circuit 44 at the center of the above-described delay circuits 44, . . . is inverted at an inverter 45 and added to the input of this delay circuit 44 at the adder 46. Also, the output of the delay circuit 44 on the lower side of this is inverted at the inverter 45 and is added to the input of the delay circuit 44 on the upper side of the above-described center delay circuit 44 and multiplied by "⅓" at the multiplier 47. The outputs of the lower sides are sequentially inverted at the inverter 45, . . . ) added to the corresponding upper side inputs at the adders 46, . . . , and multiplied by "⅕", "⅐" . . . , 1/(2+1) (n=1, 2, 3, . . . ) at the multipliers 47, . . . All of these multiplied data are added at an adder 48 and output.

The details of the convolutional operation of the Hilbert transformer 21 of FIG. 4 are exactly the same as those of the convolutional operation of the Hilbert transformer 21 of FIG. 3. However, the number of the delay circuits 44, . . . becomes half of the same, and the number of the multipliers 47, . . . becomes about one-quarter of the same.

Figure 5:
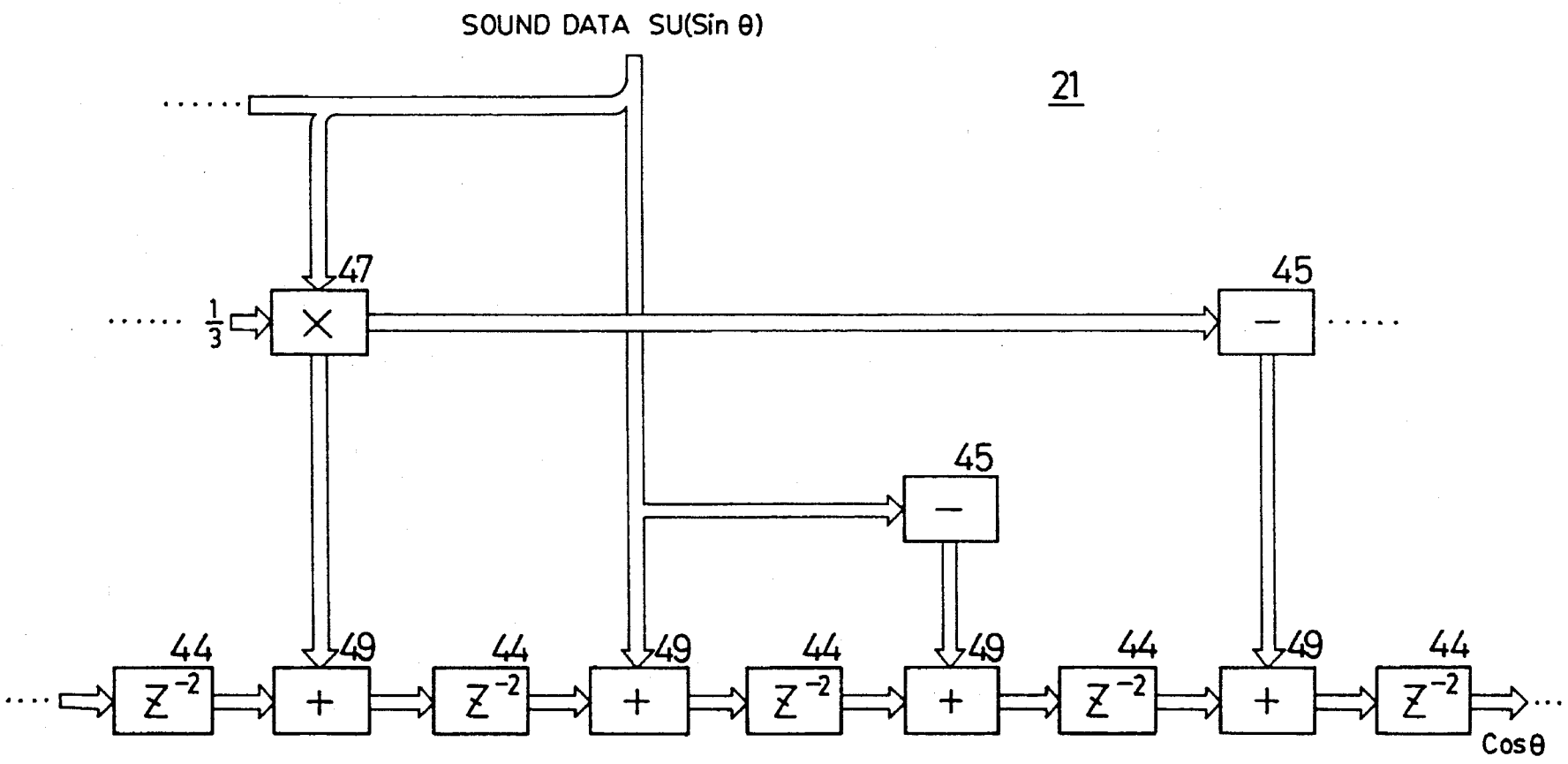
FIG. 5 is a circuit diagram of still another example of the Hilbert transformer 21.

FIG. 5 shows still another example of the Hilbert transformer 21. The above-described sound data SU is inverted at the inverter 45 and accumulated at the output of the center delay circuit 44 at the adder 49. The sound data SU is accumulated at the output of the delay circuit 44 on the upper side of the center delay circuit 44 at the adder 49 and input to the center delay circuit 44. Further, the sound data SU is multiplied by "⅓" at the multiplier 47, inverted at the inverter 45 similarly, accumulated at the adders 49 and 49, and input to the next delay circuits 44 and 44. The above-described multiplied data become "⅕", "⅐", . . . , 1/(2n+1) (n=1, 2, 3, . . . ) the further outside in location. A similar convolutional operation can be carried out in the Hilbert transformer 21 of FIG. 5.

Note that, the Hilbert transformers 21 of FIGS. 3 to 5 can be replaced by another phase control circuit or a digital signal processor, a microcomputer, or the like which executes a program operation. In this caco, the delay circuits 41 and 44 are replaced by a circuit performing operational processing which temporarily stores the sound data SU heretofore and reads out this after one or two sampling steps, the adders 43, 48, 49, . . . are replaced by a circuit performing accumulation, the multipliers 42, . . . and 47, . . . are replaced by a circuit performing multiplication, the inverter 45 is replaced by a circuit performing multiplication of "−1", and the adders 46, . . . are replaced by a circuit performing addition.

4. overall circuit

FIG. 7 shows the overall circuit of an electronic musical instrument. Each key of the keyboard 1 is scanned by a key scan circuit 2, and data indicating the key on and key off states are detected and are written in a random access memory (RAM) 6 by the CPU 5. Then, they are compared with the data indicating the ON and OFF states of the keys which have been stored in the RAM 6 heretofore, and a decision of the on event and off event of the keys and the pitch data is carried out by the CPU 5. This key scan circuit 2 and CPU 5 also perform detection of the touch data. Note that, it is also possible to replace the above-described keyboard 1 by an electronic string instrument, electronic wind (reed) instrument, electronic percussion instrument (pad, etc.), keyboard of the computer or the like.

The switches of a panel switch group 3 are scanned by a panel scan circuit 4. By this scanning operation, the data indicating the ON or OFF state of each switch is detected and is written into the RAM 6 by the CPU 5. Then, they are compared with the data indicating the ON and OFF states of the switches which have been stored in the RAM 6 heretofore. The CPU 5 discriminates the on event or off event of each switch, and the designated tone color data etc. are detected.

In the tone generator 8, the pitch in accordance with the on keys of the above-described keyboard 1, the touch of the key on or key off operation, and the musical tone waveform data in accordance with the designated tone color, etc. of the panel switch group 3 are produced. Here, the "touch" means data indicating the speed or intensity (strength) of the sound operation of the keys of the keyboard 1. In this tone generator 8, a musical tone production system of a plurality of channels, for example, 16 channels, is formed by time sharing processing, and the musical tone is polyphonically produced.

The tone waveform data produced in accordance with the tone data of the musical tones assigned to these channels are divided into tone waveform data of a right sound source and tone waveform data of a left sound source via a multi-phase control circuit 9, left and right tone waveform data are converted to sound from a right speaker 13R via a right accumulation circuit 10R, a right digital to analog converter 11R, and a right amplifier 12R and, at the same time, are converted to sound from a left speaker 13L via a left accumulation circuit 10L, a left digital to analog converter 11L, and a left amplifier 12L. In the multi-phase control circuit 9, phase control of the tone waveform data is carried out. This phase-controlled tone waveform data and the tone waveform data which is not phase-controlled are output as the tones of the right sound source or the left sound source.

The ROM 7 stores a program enabling the CPU 5 to perform various types of processing etc. In this ROM 7, a phase coefficient data table 16 is formed. The tone waveform data is stored in the waveform memory in the above-described tone generator 8, but it is also possible to store this in this ROM 7.

The RAM 6 stores various types of processing data including the above-mentioned data. In this RAM 6, an assignment memory 15 is formed. In this assignment memory 15, other than the tone data of the musical tones assigned to the 16 channel tone production system of the above-mentioned tone generator 8, phase coefficient data PC, right/left data R/L, etc. are stored. It is also possible to form this assignment memory 15 inside the tone generator 8.

5. phase coefficient data table 16

FIG. 8 shows the content of the phase coefficient data table 16 stored in the ROM 7. The phase coefficient data PC is data showing the difference between the phase of the tone waveform data of the right sound source and the phase of the tone waveform data of the left sound source as mentioned above. This phase coefficient data PC becomes a different value according to the pitch, becomes larger from the pitch C5 to the pitch C8, and, at the same time, becomes larger also from the pitch B5 toward the pitch C2.

It is also possible even if the curves of the phase coefficient data PC shown in FIG. 8 are, in addition to an algebraic function, a type of exponential function, logarithmic function, hyperbolic function, inverse hyperbolic function, trigonometrical function, or inverse trigonometrical function. Moreover, it is also possible even if the curves of the phase coefficient data PC shown in FIG. 8 are curves which are moved up or down in direction or curves moved up or down in direction only at the right half or left half, curves moved left or right in direction only at an upper half or a lower half, curves symmetrical in the left and right direction or curves symmetrical in the up and down direction, curves symmetrical in the left and right direction or symmetrical in the up and down direction only at the right half or left half, or curves symmetrical in the left and right direction or symmetrical in the up and down direction only at the upper half or the lower half. It is also possible even if each curve of the phase coefficient data PC shown in FIG. 8 is selected by the value of the musical factor data mentioned next.

This phase coefficient data PC may not only be one based on the pitch, but also one based on another musical factor or one based on the input data from the phase slide switch. This musical factor is for example the elapsed time from the start of the sound to the end of the sound, the range of tone pitch, the tone color, the amount of touch, the envelope phase, the envelope level, the musical tone part, the type of rhythm, the type of effect, the amount of effect, the modulation, the volume, or the tempo.

The values of the phase coefficient data PC are determined as shown by the curves of FIG. 8 based on the tone color of a piano, violin, flute, drum, and the like for one based on the tone color or based on the speed or intensity of the key touch for one based on the touch amount. For one based on the musical tone part, the values of the phase coefficient data PC are determined based on the musical tone parts such as the melody, chord, base, drum, backing, arpeggio, MIDI data input from the outside, auto play data, etc. as shown by the curves of FIG. 8. For one based on the type of the rhythm, as shown in the curves of FIG. 8, the values of phase coefficient data PC are determined based on the designated rhythm such as rock, disco, waltz, etc. For one based on the type of the effect, as shown in each curve of FIG. 8, the value of each phase coefficient data PC is determined based on a designated effect such as a glide, portamento, reverb, phase, etc.

For one based on the elapsed time from the start of the sound to the end of the sound, the range of tone pitohoc, envelope phase, envelope level, effect amount, modulation, volume, or the tempo or one based on the input data from the phase slide switch, as shown in the curves of FIG. 8, the values of the phase coefficient data PC are determined based on the value or magnitude of them. As the elapsed time from the start of the sound to the end of the sound, count data from the above-described time counter 30 is used. It is also possible to determine the phase coefficients of the right sound source and the left sound source based on these phase coefficient data PC or based on the added phase coefficient data PC obtained by adding the phase coefficient data PC determined in accordance with these musical factors.

Moreover, it is also possible even if these phase coefficient data PC are not stored in the ROM 7, but the phase coefficient data PC are calculated by operational equations such as, for example, PC=a(KD−b), a(b−KD), $a(KD)^2+b$, sin {a(KD)+b}, tan {a(KD)+b}, sinh {a(KD)+b}, tanh {a(KD)+b}, b/{a(KD)}, $a^{KD}+b$, $\log_a\{(KD)+b\}$ (a: constant, KD: key number data KN, b: key number data of pitch B5), etc. Further, it is also possible even if this phase coefficient data PC is input by the player by a ten-key pad etc. for every musical factor described above. In this case, the phase coefficient data PC is stored in the RAM 6.

6. multi-phase control circuit 9

Figure 9:
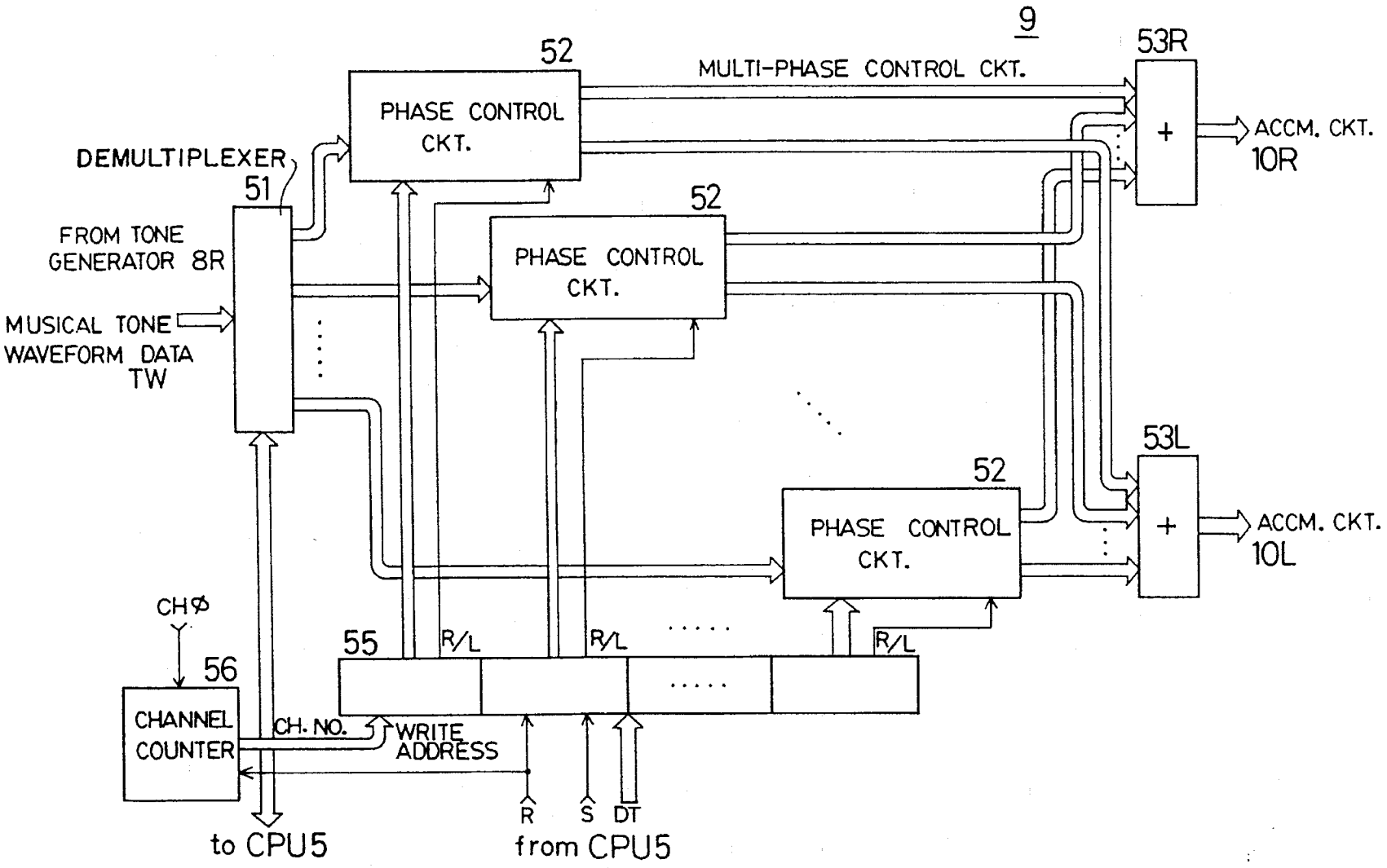
FIG. 9 is a circuit diagram of a multi-phase control circuit 9 of FIG. 2.

FIG. 9 shows the above-described multi-phase control circuit 9. The musical tone waveform data TW from the above-described tone generator 8 is distributed for every channel timing via the demultiplexer circuit 51 and input to 16 phase control circuits 52, . . . . In these phase control circuits 52, . . . the phase control of the above-described musical tone waveform data TW is carried out, and the original musical tone waveform data TW and phase shifted musical tone waveform data TWM are output. These data TW and TWM are added at the adder circuits 53R and 53L, respectively, and transmitted to the above described accumulation circuits 10R and 10L. The above described phase control circuits 52, . . . are constituted by a Hilbert transformer 21, multipliers 22 and 23, adder 24, data selectors 25R and 25L, and the phase coefficient memories 31 and 32 of the phase control circuit 20 of FIG. 1 mentioned above. Phase control is carried out in accordance with the phase coefficient data PC which is input.

On the other hand, 16 addresses are formed in the phase control data memory 55. The phase coefficient data PC are written at these addresses. The write address data is channel number data from the channel counter 56, the write designation signal is the above-described set signal S from the CPU 5, and the phase coefficient data PC are stored at corresponding channel memory areas of the above-described assignment memory 15. This channel number data is supplied also to the above-described demultiplexer circuit 51.

The phase coefficient data PC written in this phase control data memory 55 are sent to the phase coefficient memories 31 and 32 of the above-described phase control circuits 52, . . . and phase control is carried out in accordance with the magnitude of the value of the phase coefficient data PC. Also, the right/left data R/L of the most significant bit of the phase coefficient data PC is sent to the data selectors 25R and 25L of the above-described phase control circuits 52, . . . as the switching data. Also this right/left data R/L has been stored in the corresponding channel memory area of the above-described assignment memory 15.

A channel clock signal CHϕ is input to the above-described channel counter 56, and the counting of the hexadecimal channel number is carried out. When this channel number data coincides with the channel number data of the musical tone data written in the above described assignment memory 15, the above-described phase coefficient data PC is written also in the phase control data memory 55 by the CPU 5.

In the circuits of FIG. 7 to FIG. 9, different phase control can be carried out for the musical-tone of each channel. This phase control is changed in accordance with the musical factor. Note that, it is also possible even if the multi-phase control circuit 9 of FIG. 7 is omitted, the accumulation circuits 10R and 10L are combined (together), the output of this one accumulation circuit 10 is input to the phase control circuit 20 of FIG. 1 described above, and the two outputs of this phase control circuit 20 are input to the digital to analog converters 11R and 11L.

Note that, it is also possible even if the assignment memory 15 and the multi-phase control circuit 9 are constituted so that each of the channels of from 0 to 15 and each predetermined phase coefficient data PC, for example, each phase difference between each two sets selected from among "0 degree", "45 degrees", "90 degrees", "135 degrees", "180 degrees", "225 degrees", "270 degrees", and "315 degrees" correspond to each other. In this case, the phase coefficient data PC to be set in the phase control data memory 55 of FIG. 9 is fixedly set in an order of "0 degree", "45 degrees", "90 degrees", . . . , and "315 degrees". This order of phase coefficient data PC will not be rewritten by the CPU 5.

Then, musical tones to which the 0-th and eighth channels are assigned come to have a phase difference of "0 degree"; musical tones to which the first and ninth channels are assigned come to have a phase difference of "45 degrees"; musical tones to which the second and tenth channels are assigned come to have a phase difference of "90 degrees"; . . . ; and musical tones to which the seventh and 15 th channels are assigned come to have a phase difference of "315 degrees".

In response to this, which channel area of the assignment memory 15 the generated musical tone data will be written in is determined based on the above-described musical factors or the order of sound generation. This musical factor or the order of sound generation is converted via a decoder or the like to the corresponding channel number data or the above-described phase coefficient data PC.

Then, an empty channel is searched for from among the channels in accordance with these converted channel number data. The channel is assigned to the musical tone data relating to a new sound generated. Note that, two or more multi-phase control circuits 9 are provided in total, and it is also possible even if the number of the channels formed in the multi-phase control circuit 9 is decreased.

The present invention is not restricted to the above-described embodiment and can be modified in various ways within a range not out of the gist of the present invention. For example, it is also possible even if a phase slide switch is provided and this switch is slid so as to change the amount of the phase. In this case, the data in accordance with the amount of sliding of the phase slide switch is operated on (added or multiplied) with the above-described phase coefficient data PC. Further, it is also possible even if this phase slide switch can receive as input each of the above-described musical factors.

Moreover, the above-described sound systems 26R and 26L, accumulation circuits 10R and 10L, digital to analog converters 11R and 11L, amplifiers 12R and 12L, and speakers 13R and 13L are not limited to ones on the left and right. It is also possible even if provision is made of three or more of each, for example, at the top and bottom, front and back, etc., whereby a phase control system having three or more channels is constituted. In this case, in the phase control circuit 20 of FIG. 1, the Hilbert transformer 21, multipliers 22 and 23, adder 24, data selector 25L, phase coefficient memories 31 and 32 (sometimes including the time counter 30 and data selector 33) are added in exactly the amount of the number of the channels. Further, the phase control circuits 20 of the respective channels can be made different from each other. By this, one sound data SU or musical tone waveform data TW is subjected to a plurality of types of phase control, for example, phase control of "60 degrees", "120 degrees", "−60 degrees", "−120 degrees", . . . and is converted to sound from the respective sound systems.

Further, the above-described sound data SU and musical tone waveform data TW can be replaced by, in addition to the musical tones produced by digital data processing, a musical tone produced according to analog signal processing, data produced by the operational processing of the digital signal processor, data obtained by sampling and storing a voice, or data from other digital sound sources such as a tape recorder, optical disc player, television receiver, tuner, etc.

Furthermore, the type of the musical tone waveform data TW to be stored may not only correspond to sounds of musical instruments such as a piano, violin, flute, or cymbals, but may also correspond to the waveform of a sine wave, chopping wave, rectangular wave, etc., correspond to the magnitude of the content of a specific component such as the content of a harmonic component, the content of a noise component, etc., correspond to the spectral component group in accordance with a specific formant, correspond to the type of the overall waveform from the start of the sound to the end of the sound or to the middle of the sound, or correspond to the touch data, range of touch data, pitch data and/or range of pitch data.

I claim:

1. A sound control device comprising:

sound generating means for generating sound data having plural frequency components over a frequency band;

phase data generating means for generating phase data for shifting the phase of the sound data generated by said sound generating means;

phase shift means for uniformly shifting the phase of the plural frequency components of the sound data generated by said sound generating means over the entire frequency band of the sound data, based on the phase data generated by said phase data generating means, to output phase-shifted sound data;

first and second sound systems for generating sound; and data selection means, coupled to said sound generating means and said phase shift means, for selectively outputting the phase-shifted sound data output from said phase shift means and the sound data generated by said sound generating means to said first and second sound systems.

2. The sound control device of claim 1, wherein said phase shift means comprises a 90-degree phase shifter.

3. The sound control device of claim 2, wherein said 90-degree phase shifter shifts the sound data in phase by 90 degrees, said phase shift means synthesizing the 90-degree shifted sound data and the sound data generated by said sound generating means in a certain proportion to output the phase-shifted sound data.

4. The sound control device of claim 3, wherein the synthesized data comprises sine data sin A and cosine data cos A, wherein the sine data sin A is multiplied by one of the 90-degree shifted sound data and the sound data and the cosine data cos A is multiplied by the other of the 90-degree shifted sound data and the sound data.

5. The sound control device of claim 3, wherein the synthesized data is shifted along with a lapse of time.

6. The sound control device of claim 3, where in the synthesized data is shifted in accordance with a musical factor of the sound data.

7. The sound control device of claim 1, wherein said sound generating means, said phase data generating means, said phase shift means, and said data selection means perform processing in a time divisional manner for a plurality of sound data.

8. The sound control device of claim 1, wherein said data selection means synthesizes the phase-shifted sound data and the sound data and outputs the synthesized result or further distributes the synthesized result.

9. The sound control device of claim 3, wherein the synthesized data is subjected to processing in a time divisional manner with respect to a plurality of sound data, respectively.

10. A sound control method comprising:

(a) generating sound data having plural frequency components over a frequency band;

(b) generating phase data for shifting the phase of the sound data generated in said step (a);

(c) uniformly shifting the phase of the plural frequency components of the sound data generated in said step (a) over the entire frequency band of the sound data based on the phase data generated in said step (b) to provide phase-shifted sound data; and (d) selectively providing the phase-shifted sound data in phase provided in said step (c) and the sound data generated in said step (a) to first and second sound systems.

11. The sound control method of claim 10, wherein said step (b) comprises phase shifting the sound data 90 degrees.

12. The sound control method of claim 11, wherein said step (c) comprises synthesizing the 90-degree shifted sound data and the sound data generated in step (a) in a certain proportion to provide the phase-shifted sound data.

13. The sound control method of claim 12, wherein the synthesized data comprises sine data sin A and cosine data cos A, wherein the sine data sin A is multiplied by one of the 90-degree shifted sound data and the sound data and the cosine data cos A is multiplied by the other of the 90- degree shifted sound data and the sound data in said step (c).

14. The sound control method of claim 12, wherein the synthesized data is shifted along with a lapse of time.

15. The sound control method of claim 12, where in the synthesized data is shifted in accordance with a musical factor of the sound data.

16. The sound control method of claim 10, wherein said steps (a), (b), (c), and (d) perform processing in a time divisional manner for a plurality of sound data.

17. The sound control method of claim 10, wherein said step (d) comprises synthesizing the phase-shifted sound data and the sound data and providing the synthesized result or further distributing the synthesized result.

18. The sound control method of claim 12, where in the synthesized data is subjected to processing in a time divisional manner with respect to a plurality of sound data.

* * * * *